US005099741A

United States Patent [19]

Komatsu et al.

[11] Patent Number: 5,099,741

[45] Date of Patent: Mar. 31, 1992

[54] TONE GENERATING APPARATUS

[75] Inventors: Akiko Komatsu; Yasushi Sato, both of Hamamatsu, Japan

[73] Assignee: Kabushiki Kaisha Kawai Gakki Seisakusho, Japan

[21] Appl. No.: 682,922

[22] Filed: Apr. 9, 1991

[30] Foreign Application Priority Data

Apr. 12, 1990 [JP] Japan ..... 2-95064

[51] Int. Cl.[5] ..... G10H 1/057; G10H 1/08; G10H 1/18

[52] U.S. Cl. ..... 84/653; 84/660; 84/663

[58] Field of Search ..... 84/615, 625, 627, 653, 84/660, 663, 678, 697, 698, 702, 703, 735, 738, 742

[56] References Cited

U.S. PATENT DOCUMENTS 3,924,505 12/1975 Schrecongost ..... 84/678

4,539,883 9/1985 Chihana ..... 84/625

*Primary Examiner*—Stanley J. Witkowski

*Attorney, Agent, or Firm*—Bruce L. Adams; Van C. Wilks

[57] ABSTRACT

A tone generating apparatus is provided with the same number of tone signal generating circuits as a polyphonic number, each of which generate multiple tone-component signals having a relatively long tone-ON time and combine the signals to produce a tone signal, and is also provided with the same number of tone signal generating circuits as a predetermined number smaller than the polyphonic number, the latter circuits each generating a tone-component signal having a relatively short tone-ON time. With this arrangement, when tone generation is specified by depression of a key, for example, generation of a musical tone having a relatively long tone-ON time is assigned to one of the former tone signal generating circuits, and, at the same time, generation of a musical tone having a relatively short tone-ON time is assigned to one of the latter tone signal generating circuits, thereby generating a single tone signal.

6 Claims, 8 Drawing Sheets

Fig. 5

| CHANNEL NO. m | KEY STATUS ST | KEY NO. NO | DEPRESSING TIME |
|---|---|---|---|
| 1 | 1 | 25 | 1.175 |
| 2 | 1 | 26 | 1.189 |
| 3 | 0 | — | 0.512 |
| ⋮ | ⋮ | ⋮ | ⋮ |
| 15 | 1 | 10 | 2.318 |

KEY STATUS
{0 : RELEASE
1 : DEPRESS

Fig. 6

| CHANNEL NO. n | KEY STATUS ST | KEY NO. NO | DEPRESSING TIME |
|---|---|---|---|
| 1 | 1 | 15 | 2.318 |
| 2 | 0 | — | 2.259 |

TONE GENERATING APPARATUS

BACKGROUND OF THE INVENTION

1. Field of the Invention

The present invention relates to a tone generating apparatus for use in an electronic musical instrument, which generates musical tones. More particularly, this invention pertains to a tone generating apparatus which can generate conventionally-available musical tones although the number of digital controlled oscillators (each hereinafter referred to as DCO) is reduced.

2. Description of the Related Art

Conventional tone generating apparatuses for use in electronic musical instruments, such as an electronic organ and an electronic piano, each have multiple DCOs as tone generating sources. Some of these DCOs are properly combined and are driven to generate tone signals. The combination is determined in accordance with, for example, the timbre designated through an operation panel, the tone range specified through a keyboard, etc.

More specifically, the tone generating apparatus includes the same number of tone generating circuits as the number of polyphonic sounds (the number of simultaneously-generatable tones). One tone generating circuit corresponds to one key. Each tone generating circuit has four DCOs 1 to 4 which respectively generate tone signals of individual components, attack, decay, high and noise. The four oscillators, DCO 1 to DCO 4, are simultaneously operable when one key is depressed.

The attack component, decay (attenuating sound) component and high (hard hitting sound) component, which constitute one tone, have a relatively long tone-generating time or tone-ON time. The frequencies of these tone components vary in proportion to the pitch. The noise (striking sound) component has a relatively short tone-ON time, and has a frequency that should not necessarily be proportional to the pitch.

The mentioned tone components are respectively generated by the four oscillators DCO 1 to DCO 4. The generated four tone components undergo a predetermined arithmetic operation to be synthesized together, thus yielding a single tone signal.

Musical tones generated by the thus constituted tone generating apparatus become closer to the tones of a natural musical instrument.

The conventional tone generating apparatus, as explained above, has the same number of oscillators for a noise component as the number of polyphonic sounds, in order to generate striking sounds having a short tone-ON time, as well as oscillators for the other tone components having a long tone-ON time. At the time a musical tone is generated, a channel is assigned to generate the striking sound as is done for generation of the other tone components having a long tone-ON time.

However, the striking sound does not vary in accordance with the pitch, i.e., the position of a depressed key. Further, the striking sound will attenuate immediately after it is generated for a short period of time. To provide the same number of oscillators for generation of the noise component as the polyphonic number and assign a channel to the noise generation requires a great amount of hardware and results in a complicated structure. This means that the tone generating apparatus becomes expensive.

SUMMARY OF THE INVENTION

The present invention has been developed to overcome the above shortcomings of the conventional tone generating apparatus. It is therefore an object of this invention to provide a low-cost tone generating apparatus with a simple structure, which can be realized with fewer hardware without reducing the polyphonic number.

As shown in the principle diagram in FIG. 1, the tone generating apparatus according to the present invention comprises first tone signal generating means including tone signal generating circuits $\mathbf{51}_1, \mathbf{51}_2, \ldots, \mathbf{51}_m$ each for generating a tone signal d from multiple tone-component signals a to c having a relatively long tone-ON time in association with a polyphonic number m, second tone signal generating means including tone signal generating circuits $\mathbf{52}_1, \mathbf{52}_2, \ldots, \mathbf{52}_n$ each for generating a tone signal from a tone-component signal e having a relatively short tone-ON time in association with a predetermined number n smaller than the polyphonic number m, first assigning means 53 for assigning tone generation to one of the tone signal generating circuits of the first tone signal generating means when tone generation is specified, and second assigning means 54 for assigning tone generation to one of the tone signal generating circuits of the second tone signal generating means.

The present invention utilizes the characteristic that, for example, the noise-component signal e (striking sound) is generated only for a short period of time.

The tone generating apparatus is provided with the same number of tone signal generating circuits $\mathbf{51}_1, \mathbf{51}_2, \ldots, \mathbf{51}_m$ as the polyphonic number m, each of which generates multiple tone-component signals a to c having a relatively long tone-ON time and combines the signals to produce a tone signal d, and is also provided with the same number of tone signal generating circuits $\mathbf{52}_1, \mathbf{52}_2, \ldots, \mathbf{52}_n$ as the predetermined number n smaller than the polyphonic number m, the latter circuits each generating a tone-component signal e having a relatively short tone-ON time. With this arrangement, when tone generation is specified by depression of a key, for example, generation of a musical tone having a relatively long tone-ON time is assigned to one of the tone signal generating circuits $\mathbf{51}_1, \mathbf{51}_2, \ldots, \mathbf{51}_m$, and, at the same time, generation of a musical tone having a relatively short tone-ON time is assigned to one of the tone signal generating circuits $\mathbf{52}_1, \mathbf{52}_2, \ldots, \mathbf{52}_n$, thereby generating a single tone signal.

Since the time for generating musical tones from the tone signal generating circuits $\mathbf{52}_1, \mathbf{52}_2, \ldots, \mathbf{52}_n$ is short, it is possible to change assigning of tone generation one after another. Therefore, fewer tone signal generating circuits $\mathbf{52}_1$ to $\mathbf{52}_n$ are required, permitting a tone generating apparatus with a simple structure to be realized by fewer hardware.

BRIEF DESCRIPTION OF THE DRAWINGS

FIGS. 5 and 6 are diagrams illustrating the structures of assigner memories according to the present invention;

DETAILED DESCRIPTION OF THE PREFERRED EMBODIMENT

Figure 1:
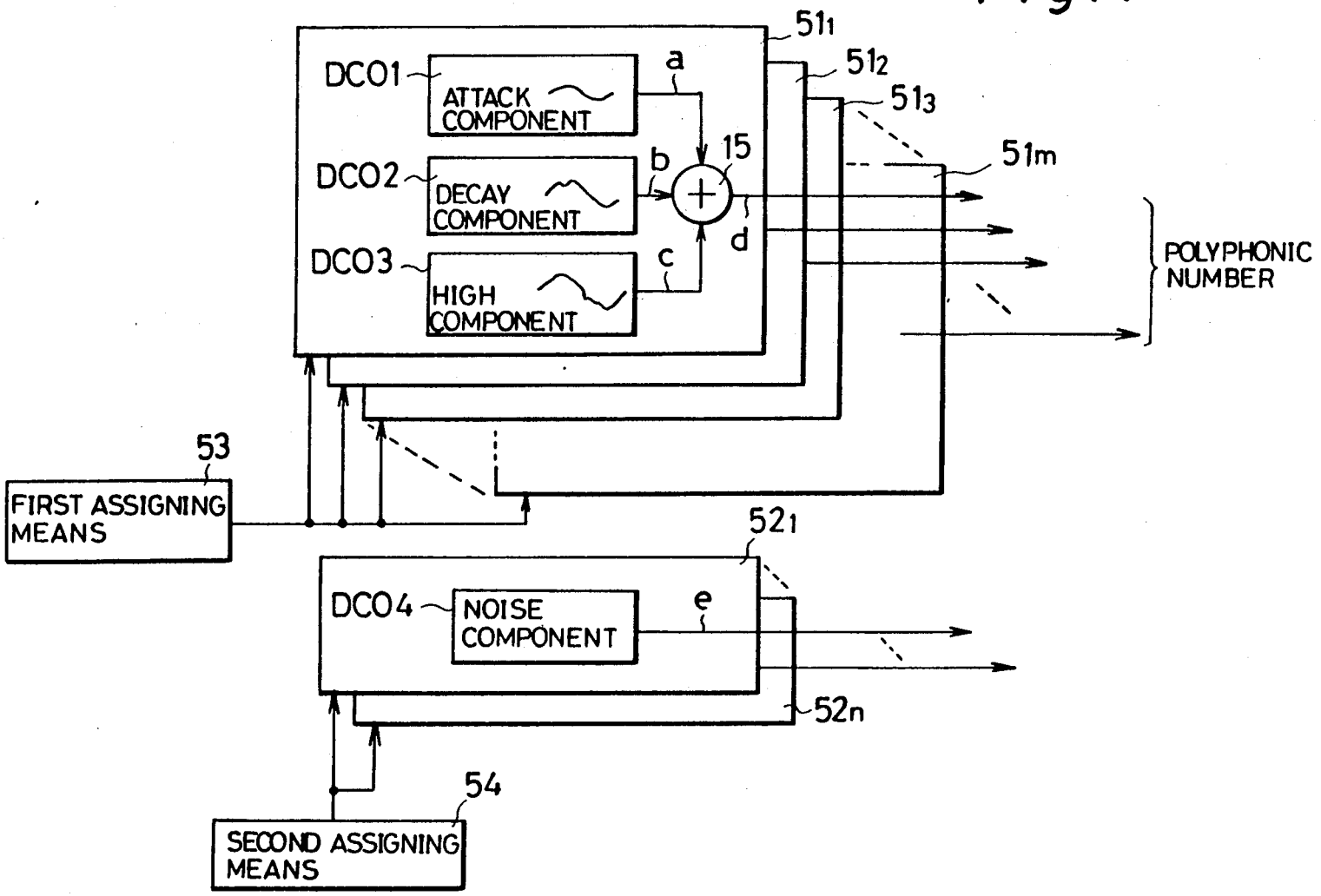
FIG. 1 is a diagram illustrating the principle of the present invention.
Figure 2:
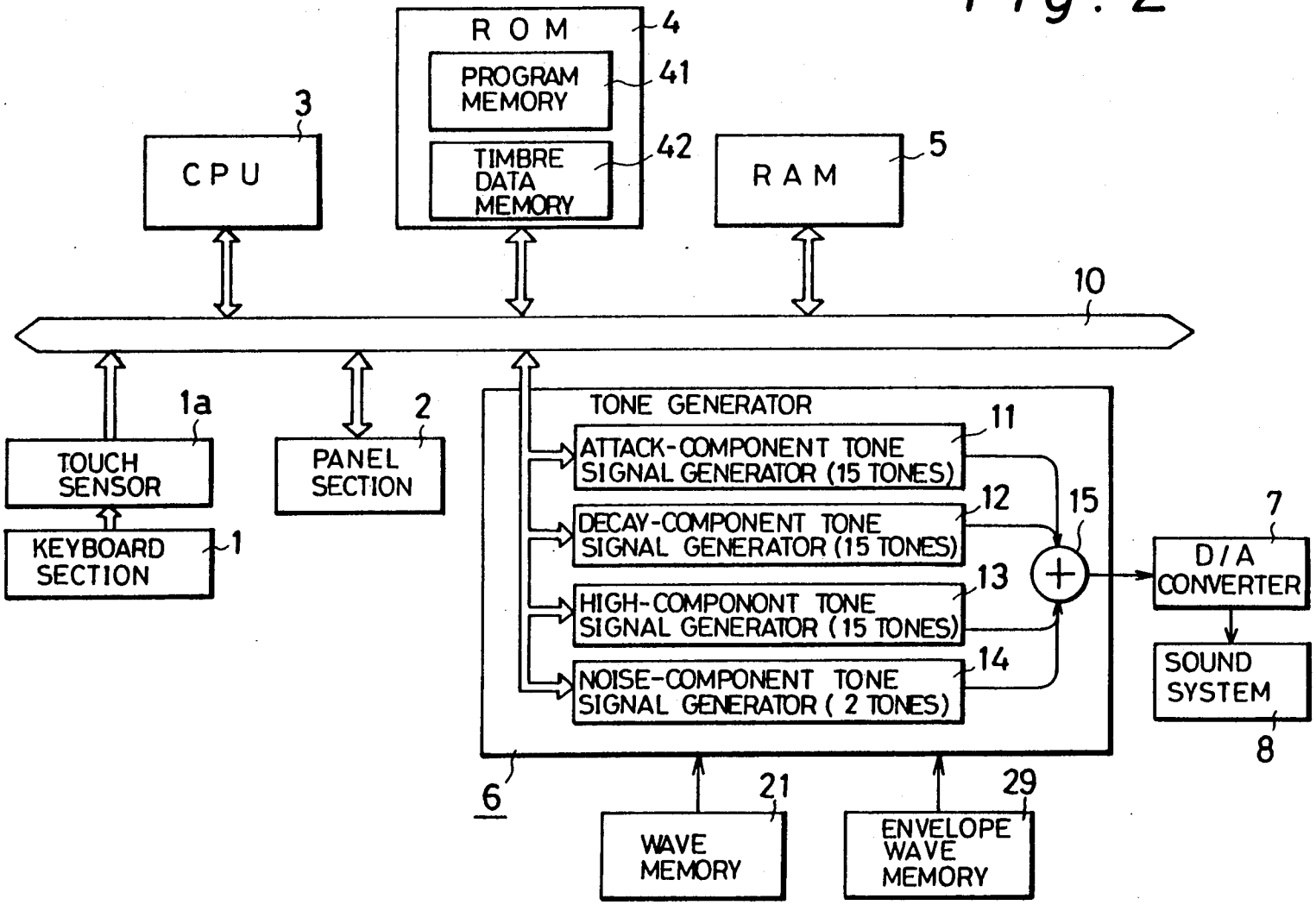
FIG. 2 is a block diagram showing the structures of the essential portions of an electronic musical instrument to which the present invention is applied.

FIG. 2 presents a block diagram illustrating the structures of the essential portions of an electronic musical instrument to which a tone generating apparatus according to the present invention is applied. The following description will be given with reference to the case where the number of tone generating circuits, which combine the attack component, decay component and high component to generate a tone signal, i.e., the polyphonic number, is fifteen and the number of tone generating circuits for the noise component is two.

In FIG. 2, a keyboard section 1 is constituted by a keyboard having a plurality of keys. The keyboard section 1 includes a key scan circuit to detect the depression status of each key. The ON/OFF status of each key of the keyboard section 1 is sent to a CPU (Central Processing Unit) 3.

A touch sensor 1*a* serves to detect the key touch strength in accordance with a signal from the keyboard section 1. Touch data representing the key touch strength is sent to the CPU 3.

A panel section 2 includes various switches, such as a power switch, a mode select switch, a melody select switch and a rhythm select switch.

The CPU 3 controls the individual sections of the electronic musical instrument in accordance with a control program stored in a program memory section 41 in a ROM (Read Only Memory) 4.

The ROM 4 has a timbre data memory section 42 besides the program memory section 41. Stored in the timbre data memory section 42 is information for generating a musical tone, such as a frequency number, wave number, envelope wave number and mode data. The contents of the ROM 4 are specified by a timbre pointer. The data in the ROM 4 which is designed by the timbre pointer is read out in accordance with the operation of the panel section 2 and the operation of the keyboard section 1. The read-out content of the ROM 4 is subjected to an arithmetic operation or the like before it is sent to the tone generating apparatus.

A RAM (Random Access Memory) 5 has a data area, multiple register areas, an assigner memory area and the like allocated therein.

The data area serves to store predetermined data in the ROM 4 which is transferred under the control of the CPU 3.

The register areas include multiple registers where data corresponding to the statuses of the individual keys of the keyboard section 1, the touch sensor 1*a* and the switches of the panel section 2 is set.

The assigner memory area includes assigner memories A and B which store data for assigning tone generating circuits (to be described later) to unused channels.

A tone generator 6, which generates tone signals, comprises an attack-component tone signal generator 11, decay-component tone signal generator 12, high-component tone signal generator 13, noise-component tone signal generator 14 and an adder 15 for adding signals from these tone signal generators.

The attack-component tone signal generator 11 generates a sound which rises at the beginning of a musical tone and attenuates soon thereafter. The decay-component tone signal generator 12 generates an attenuating sound which is sustained after gentle rise, then gradually attenuates. The high-component tone signal generator 13 produces a hard-hitting tone which sounds strong when a key is struck hard. The noise-component tone signal generator 14 produces a striking sound which is generated, for example, when a key is struck.

The tone signal generators 11, 12 and 13 each have fifteen identical circuits to ensure simultaneous generation of fifteen tones. The noise-component tone signal generator 14 has two identical circuits to ensure simultaneous generation of two tones. The details of these circuits will be described later.

To the tone generator 6 are connected a wave memory 21 for storing wave data and an envelope wave memory 29 for storing envelope data; these memories will be described in detail later.

A digital tone signal output from the tone generator 6 is supplied to a D/A converter 7, which in turns converts the tone signal into an analog tone signal. The analog tone signal output from the D/A converter 7 is supplied to a sound system 8. The sound system 8, which comprises loudspeakers, or headphone or the like, for example, converts the received analog tone signal into an acoustic signal.

The touch sensor 1*a* (keyboard section 1), panel section 2, CPU 3, ROM 4, RAM 5 and tone generator 6 are mutually connected by a system bus 10.

Figure 3:
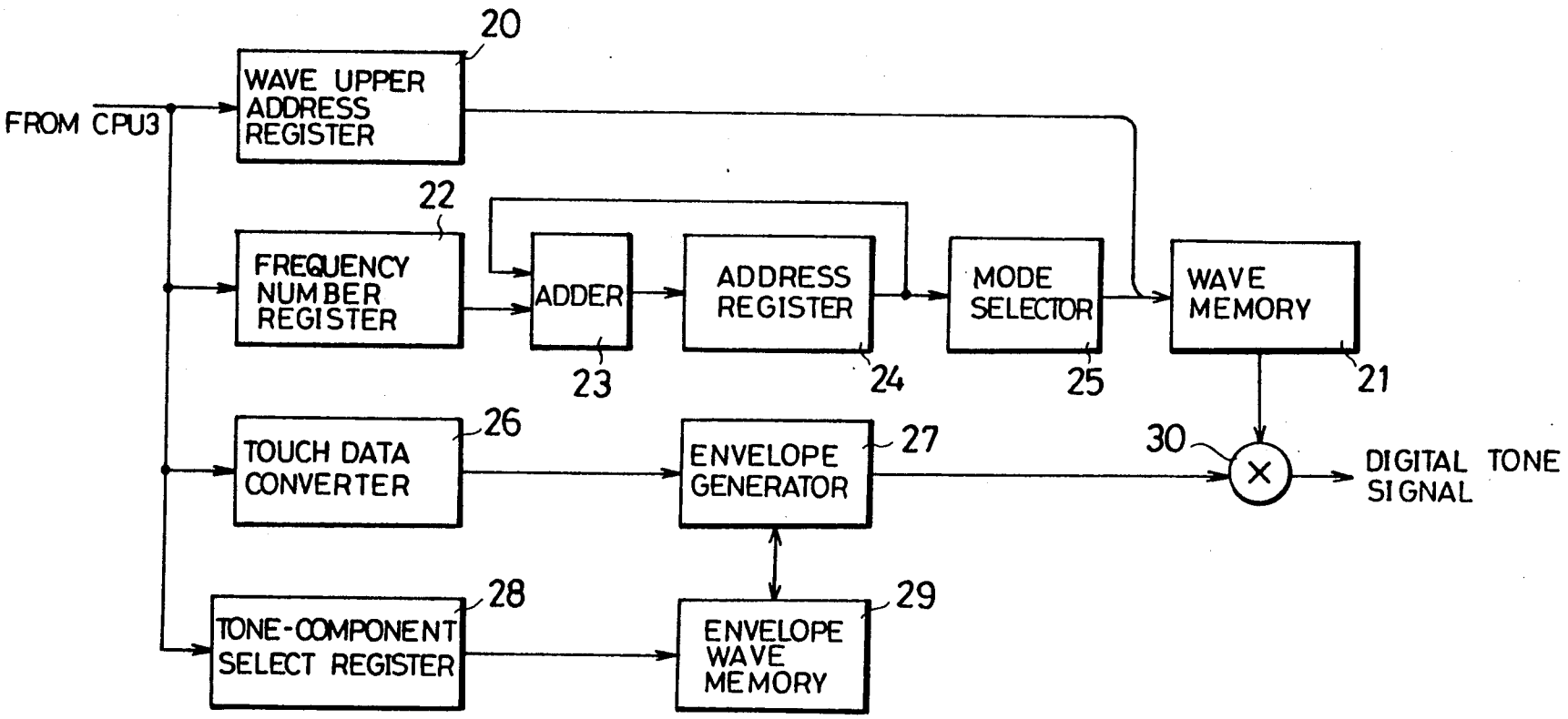
FIG. 3 is a block diagram illustrating the structure of a tone generating circuit according to one embodiment of the present invention.

FIG. 3 illustrates the detailed structure of the tone generating circuits. The aforementioned attack-component tone signal generator 11, decay-component tone signal generator 12, high-component tone signal generator 13 and noise-component tone signal generator 14 are constituted by identical circuits. These tone signal generators respectively generate tone signals of the attack, decay, high and noise components under the control of the CPU 3.

Referring to this diagram, a wave upper address register 20 stores a wave upper address sent from the CPU 3. The output of this address register 20 is supplied to the wave memory 21, and is used to select waves stored in the wave memory 21 in accordance with the timbre and tone range.

The wave memory 21 is a read only memory having wave data stored therein. This memory 21 outputs wave data from the area addressed by the wave upper address from the wave upper address register 20 and a wave lower address from a mode selector 25 which will be described later. The speed (frequency) for reading wave data from the wave memory 21 is proportional to a frequency number which is generated in association with a key number.

A frequency number register 22 stores the frequency number sent from the CPU 3. The frequency number is used to control the speed for reading wave data from the wave memory 21.

The frequency number actually indicates an increase in a read address of the wave memory 21. Therefore, when the frequency number is small, wave data is read out at a small pitch (address interval), thus generating a tone signal of a low frequency. When the frequency number is large, however, wave data is read out at a large pitch (address interval), thus generating a tone signal of a high frequency.

The output of the frequency number register 22 is sent to one input of an adder 23. The adder 23 receives the output of the frequency number register 22 as one input and the output of an address register 24 as the other input and adds the inputs together. The output of the adder 23 or the result of the addition is supplied again to the address register 24.

The address register 24 stores the output of the adder 23. The address register 24 and the adder 23 constitute an accumulator. The content (wave lower address) of the address register 24 is supplied via the mode selector 25 to the wave memory 21.

The mode selector 25 controls modes to read wave data from the wave memory 21. The following modes are examples of the read modes. The first mode is to sequentially read data from the area in the wave memory 21 specified by the wave upper address in an address-increasing direction, and then return to the start address and repeat the above operation when the last address is reached. The second mode is to sequentially read data from the area in the wave memory 21 specified by the wave upper address in an address-increasing direction, and then read data in an address-decreasing direction (reverse direction) when the last address is reached. The read modes, including other various modes, are all controlled by a control signal (not shown) from the CPU 3. The output of the mode selector 25 is supplied as the wave lower address to the wave memory 21.

A touch data converter 26 converts touch data of a predetermined format, sent from the CPU 3, into touch data of a format that allows the tone generating circuit to handle the data. The "touch data" is data originating from the detection of the strength of key depression by the touch sensor 1*a*. The output of the touch data converter 26 is supplied to an envelope generator 27.

A tone-component select register 28 stores data that specifies the type of tone components, such as the attack component, decay component, high component and noise component, sent from the CPU 3. The output of this register 28 is supplied to an envelope wave memory 29.

The envelope wave memory 29 stores various types of envelope data according to tone components. This wave memory 29 is addressed by the content of the tone-component select register 28, whereby predetermined envelope data is read out from the memory 29.

The envelope generator 27 generates an envelope signal. That is, the envelope generator 27 converts envelope data sequentially read out from the envelope wave memory 29 into data having a level (amplitude) corresponding to the touch data from the touch data converter 26, and generates a corresponding envelope signal. The output of this envelope generator 27 is supplied to a multiplier 30.

The multiplier 30 multiplies wave data read out from the wave memory 21 by the envelope signal from the envelope generator 27. As a result, a digital tone signal having and envelope added to the wave data is generated. The output of the multiplier 30 is supplied to the adder 15 (see FIG. 2) as one tone-component signal of a predetermined channel.

Referring to FIG. 3, the wave memory 21 and envelope wave memory 29 are shared by the individual tone generating circuits, and the other portions are hardware provided in each tone generating circuit.

The above-described tone generating circuit may be operated in a time-shared manner. In this case, a single tone generating circuit can realize the functions of multiple tone generating circuits, thus reducing the amount of hardware required to constitute the tone generating circuits.

Figure 4:
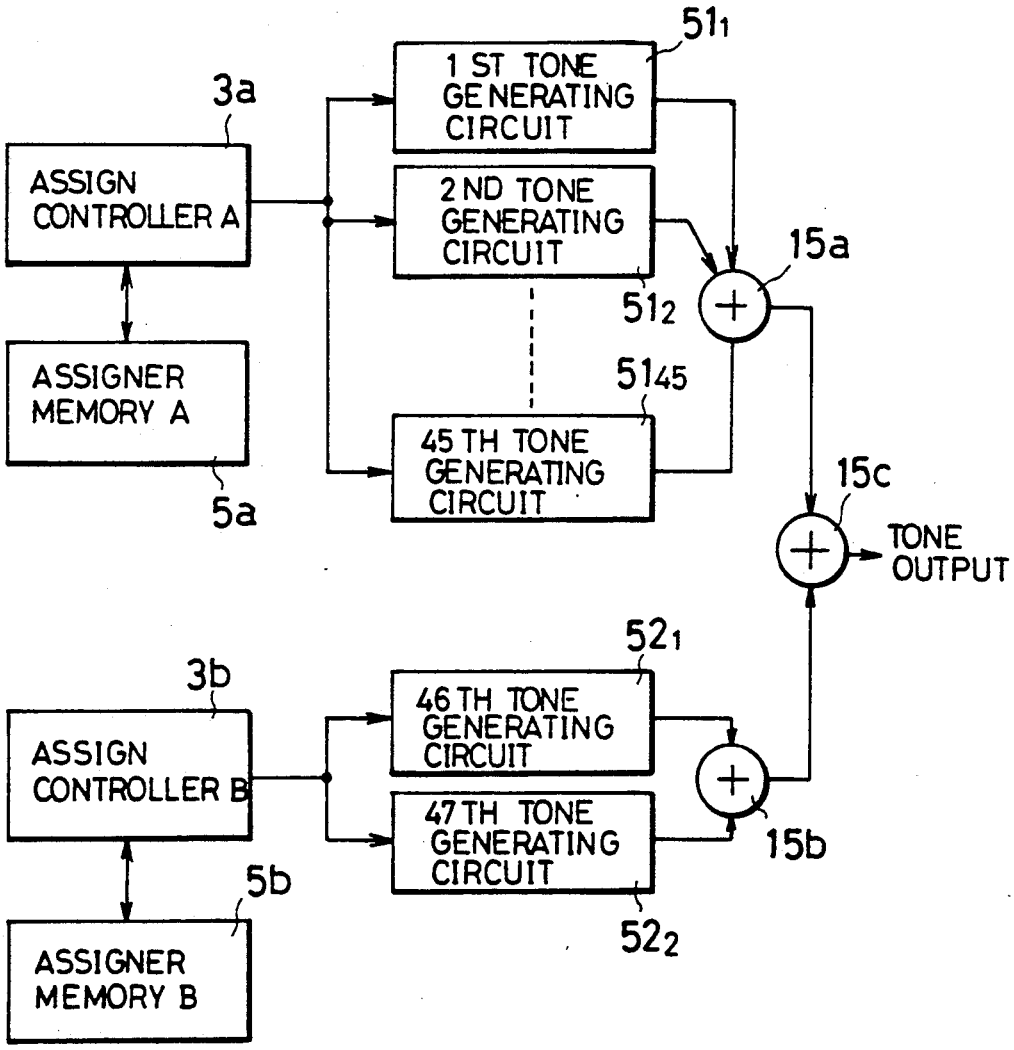
FIG. 4 is a block diagram showing the tone generating circuit and its control system according to the embodiment of the present invention.

FIG. 4 illustrate the structure of the tone generating circuit as the above-described tone signal generating means and the structure of a control system for the tone generating circuit.

Referring to this diagram, first to forty-fifth tone generating circuits $51_1$ to $51_{45}$ correspond to the attack-component tone signal generator 11, decay-component tone signal generator 12 and high-component tone signal generator 13 each for fifteen polyphonic sounds; the ordinal numerals, such as the first, second, and third, will be hereinafter expressed as 1st, 2nd, 3rd, and so forth for simplification. The 46th and 47th tone generating circuits $52_1$ and $52_2$ correspond to the noise-component tone signal generator 14 for two polyphonic sounds. Adders 15*a*, 15*b* and 15*c* correspond to the adder 15 shown in FIG. 2.

An assign controller A 3*a*, which is realized by the function of the CPU 3, controls the 1st to 45th tone generating circuits $51_1$ to $51_{45}$. The assign controller A 3*a* performs a channel assign process in accordance with the content of an assigner memory A 5*a* provided in the RAM 5.

An assign controller B 3*b*, which is also realized by the function of the CPU 3, controls the 46th and 47th tone generating circuits $52_1$ to $52_2$. The assign controller B 3*b* performs a channel assign process in accordance with the content of an assigner memory B 5*b* provided in the RAM 5.

FIG. 5 exemplifies the assigner memory A. The assigner memory A is constituted by a channel number m, a key status ST, a key number NO and a key-depressing time. The channel number m indicates one of first to fifteenth channels. The key status ST represents a key-released status when it is "0" and a key-depressed status when it is "1." The key number NO indicates the number of that key on the keyboard section 1 which is assigned to the channel m. The key-depressing time is the time stored when that key has been depressed.

FIG. 6 exemplifies the assigner memory B, which has the same structure as the assigner memory A.

The operation of the tone generating apparatus having the above-described structure will be described below referring to the flowcharts given in FIGS. 7 and 8. Hereunder, the description will be given mainly with reference to the channel assign process.

Figure 7:
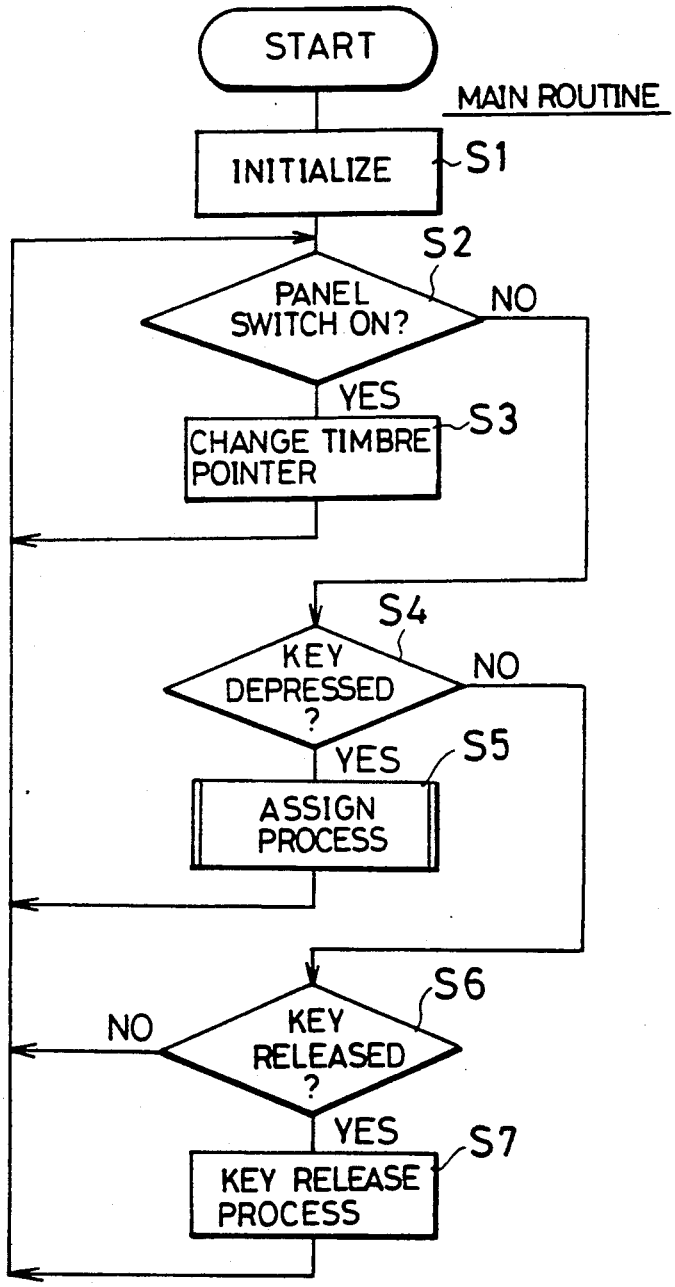
FIGS. 7 and 8 are flowcharts for explaining the operation of the embodiment of the present invention.

FIG. 7 shows the main routine for an electronic musical instrument. First, when the power switch (not shown) on the panel section 2 is set ON, an initialization is executed (step S1). In the initialization, the registers in the CPU 3 and the registers allocated in the RAM 5 are initialized, predetermined data stored in the ROM 4 is transferred to the RAM 5, then, the timbre pointer is initialized to determine an initial timbre to be generated.

When this initialization is completed, it is determined whether or not any panel switch on the panel section 2 is set ON (step S2). If it is judged that one of the panel switches has been set ON, the timbre pointer is changed in accordance with the content of that switch (step S3). Then, the flow returns to step S2 and the above process sequence is repeated.

If it is judged in step S2 that no panel switch has been set ON, it is determined whether or not a key on the keyboard section 1 has been depressed (step S4).

If it is judged that such key depression has occurred, an assign process will be executed (step S5). This assign process assigns the tone generating circuit to a predetermined channel. Further, the CPU 3 transfers data concerning the timbre, touch, tone range and the like to the tone generating circuit, and then instructs it to start tone generation. As a result, the tone generator 6 executes the above-described operation and the sound system 8 releases musical tones. Then, the flow returns to step S2 and the above process sequence is repeated. This assign process will be described in detail later.

If it is judged in step S4 that no key has been depressed, it is determined whether or not any key release has occurred (step S6). If it is judged that key release has occurred, a key release process will be executed next (step S7). In this key release process, the CPU 3 transfers data concerning the timbre, touch, tone range and the like to the tone generating circuit, and then instructs it to stop the tone generation. As a result, the sound system 8 stops generating musical tones. Then, the flow returns to step S2 and the above process sequence is repeated. Even if it is judged in step S6 that no key release has occurred, the flow returns to step S2.

By repeating the process sequence from steps S2 to S7, musical tones are generated while changing the timbre, pitch, etc. in accordance with the operation of the panel switches on the panel section 2 and the key operation of the keyboard section 1.

Figure 8:
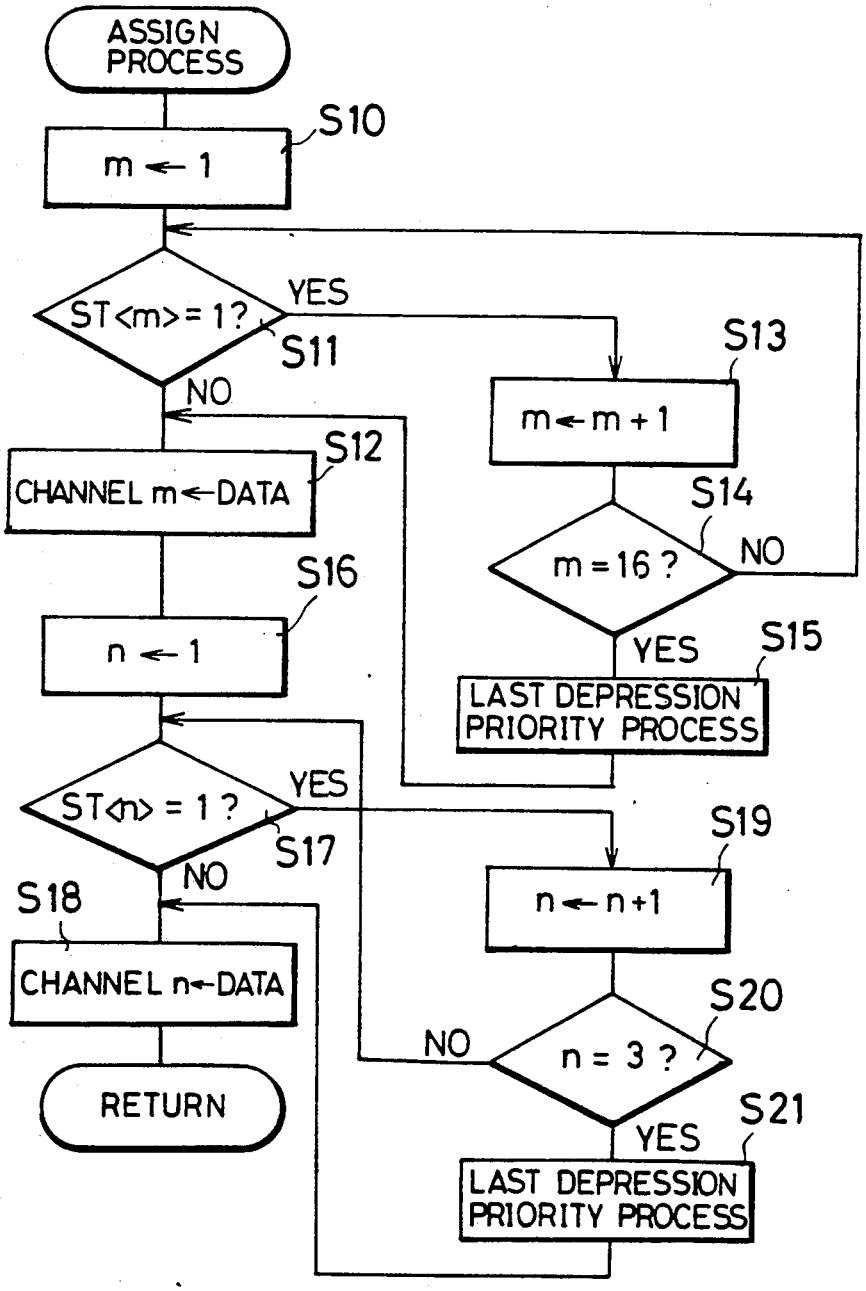

FIG. 8 presents a detailed flowchart of the assign process of step S5.

In the assign process, first, the channel number m is initialized to "1" (step S10). Then, the key status ST<m> of that channel number m is checked (step S11). When the key status ST of the key assigned to the channel number m is judged to be "1," i.e., when the key status is judged to be the key-depressed status, that channel cannot be used. Consequently, the channel number m is incremented (step S13), and it is checked if the channel number m becomes "16" (step S14). If it is not judged that the channel number m is "16," the flow returns to step S11 to check the key status ST<m> for the next channel.

When a channel for which the key status ST is "0" or an unused channel is found through repetition of the above operation, data is sent to that channel (step S12). As a result, the tone generating circuit for this channel is driven to generate a musical tone.

If it is judged in step S14 that the channel number m is "16," which means that all fifteen channels are in use, a last depression priority process will be executed (step S15). More specifically, the key-depressing time table in the assigner memory A is checked and tone generation is assigned to that channel which has the oldest key-depressing time. In other words, data is sent to that channel (step S12).

In the next step S16, the channel number n is initialized to "1." Then, the key status ST<n> of that channel number n in the assigner memory B is checked (step S17). When the key status ST of the key assigned to the channel number n is judged to be "1," i.e., when that channel is already in use, the channel cannot be used. Consequently, the channel number n is incremented (step S19), and it is checked if the channel number n becomes "3" (step S20). If it is not judged that the channel number n is "3," the flow returns to step S17 to check the key status ST<n> for the next channel.

When a channel for which the key status ST is "0" or an unused channel is found through the above process sequence, data is sent to that channel (step S18). As a result, the tone generating circuit for this channel is driven to generate a musical tone for a striking sound or noise component.

If it is judged in step S20 that the channel number n is "3," which means that both channels are in use, a last depression priority process will be executed (step S21). More specifically, the key-depressing time table in the assigner memory B is checked and tone generation is assigned to that channel which has an older key-depressing time. In other words, data is sent to that channel (step S18).

As described above, the tone generating apparatus is provided with the same number of tone signal generating circuits $51_1, 51_2, \ldots, 51_{45}$ as the polyphonic number "15," each of which generates tone signals of the attack, decay and high components having a relatively long tone-ON time, and is also provided with two tone signal generating circuits $52_1$ an $52_2$, each of which generates a tone signal, such as a striking sound, having a relatively short tone-ON time, whereby a tone signal of the attack, decay or high component is generated by one of the tone generating circuits $51_1, 51_2, \ldots, 51_{45}$, while a tone signal of a striking sound is generated either the tone signal generating circuit $52_1$ or $52_2$. It is therefore possible to reduce the number of tone generating circuits required and thus realize a tone generating apparatus with a simple structure by fewer hardware.

Figure 9:
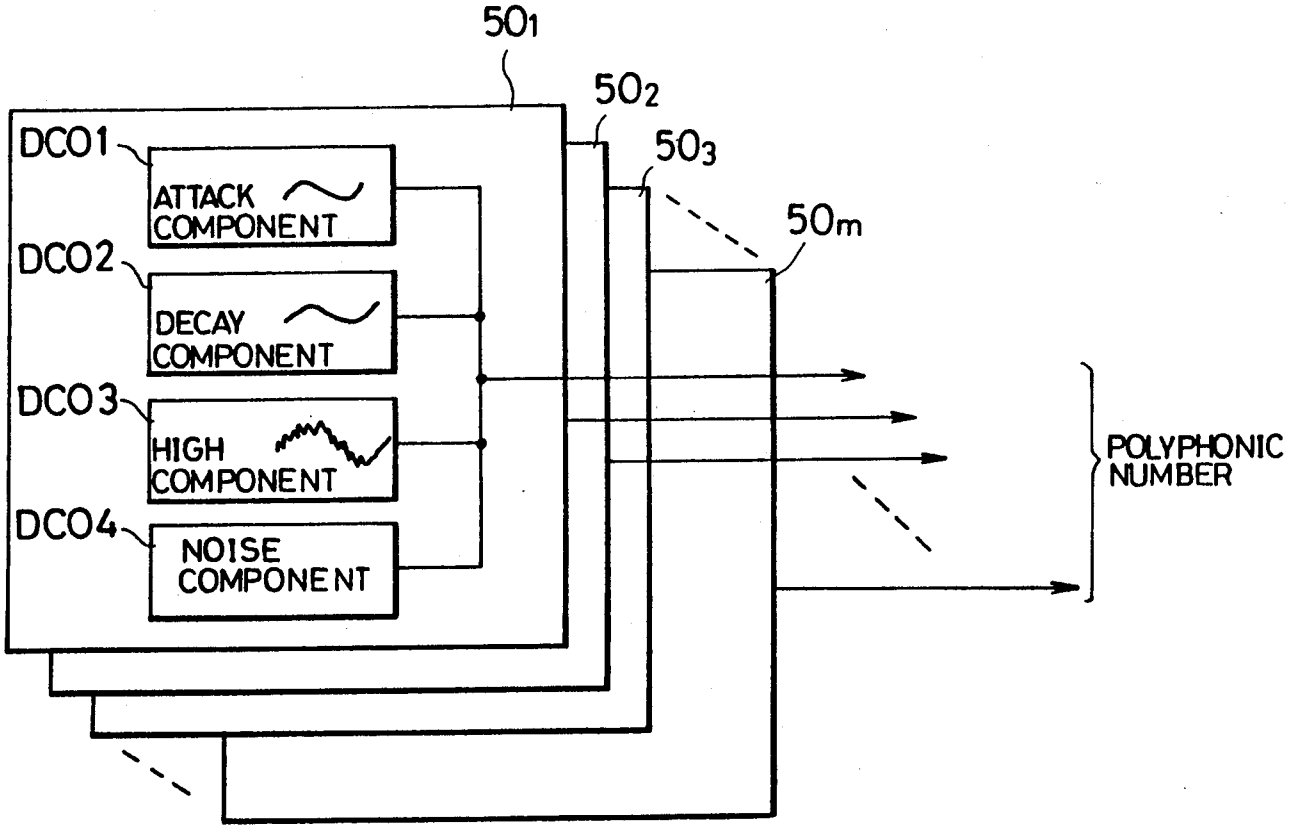
FIG. 9 is a diagram for explaining an ordinary tone generating apparatus.

The tone generating apparatus according to the present invention will be described below in comparison with an ordinary tone generating apparatus. FIG. 9 illustrates one example of an ordinary tone generating apparatus.

Referring to this diagram, reference numerals $50_1$ to $50_n$ are tone generating circuits corresponding to respective keys of a keyboard instrument. When one key is depressed, four oscillators DCO 1 to DCO 4 of the associated tone generating circuit are simultaneously driven. In the illustrated example, the same number of oscillators for noise generation as the number of polyphonic sounds are provided in order to generate striking sounds having a short tone-ON time, like the tone generators for the other tone components having a long tone-ON time.

The above-described embodiment, however, uses fewer DCOs for generating a striking sound having a short tone-ON time than the polyphonic number and thus requires a smaller amount of hardware, resulting in a simpler structure. The tone generating apparatus of the present invention can be manufactured at a low cost.

The foregoing description of this embodiment has been given with reference to the case where the tone generating apparatus is provided with two tone signal generating circuits $52_1$ an $52_2$, each of which generates a tone signal, such as a striking sound, having a relatively short tone-ON time, in addition to the same number of tone signal generating circuits $51_1, 51_2, \ldots, 51_{45}$ as the polyphonic number "15," each of which generates tone signals of the attack, decay and high components having a relatively long tone-ON time. The polyphonic number is not however limited to fifteen, but may be any arbitrary number. Further, the number of the tone generating circuits which generate tone signals having a relatively short tone-ON time is neither limited to two; the object of the present invention can be achieved as long as this quantity is less than the polyphonic number.

As described above, the present invention can provide a low-cost tone generating apparatus with a simple structure having fewer hardware without reducing the polyphonic number.

What is claimed is:

1. A tone generating apparatus comprising:

first tone signal generating means including tone signal generating circuits each for generating a tone signal from multiple tone-component signals having a relatively long tone-ON time in association with a polyphonic number;

second tone signal generating means including tone signal generating circuits each for generating a tone signal from a tone-component signal having a relatively short tone-ON time in association with a predetermined number smaller than said polyphonic number;

first assigning means for assigning tone generation to one of said tone signal generating circuits of said first tone signal generating means when tone generation is specified; and second assigning means for assigning tone generation to one of said tone signal generating circuits of said second tone signal generating means.

2. A tone generating apparatus according to claim 1, wherein said tone signal generated by each of said tone signal generating circuits of said first tone signal generating means is acquired by synthesizing multiple tone-component signals having a relatively long tone-ON time.

3. A tone generating apparatus according to claim 1, wherein said tone signal generated by each of said tone signal generating circuits of said first tone signal generating means is acquired by adding multiple tone-component signals having a relatively long tone-ON time.

4. A tone generating apparatus according to claim 1, wherein said tone signal generated by each of said tone signal generating circuits of said first tone signal generating means is acquired by synthesizing tone-components signals for an attack component, decay component and high component having a relatively long tone-ON time.

5. A tone generating apparatus according to claim 1, wherein said tone signal generated by each of said tone signal generating circuits of said first tone signal generating means is acquired by adding tone-components signals for an attack component, decay component and high component having a relatively long tone-ON time.

6. A tone generating apparatus according to claim 1, wherein said tone signal generated by each of said tone signal generating circuits of said second tone signal generating means is generated from a noise component having a relatively short tone-ON time.

* * * * *